US006209518B1

(12) United States Patent
Machida et al.

(10) Patent No.: US 6,209,518 B1
(45) Date of Patent: Apr. 3, 2001

(54) METHOD AND APPARATUS FOR FAIL SAFE CONTROL OF AN ELECTRONICALLY CONTROLLED THROTTLE VALVE OF AN INTERNAL COMBUSTION ENGINE

(75) Inventors: Kenichi Machida, Atsugi; Masahiro Iriyama, Yokohama; Mikio Nozaki, Kamakura, all of (JP)

(73) Assignees: Unisia Jecs Corporation; Nissan Motor Co., Ltd., both of Kanagawa-ken (JP)

( * ) Notice: Subject to any disclaimer, the term of this patent is extended or adjusted under 35 U.S.C. 154(b) by 0 days.

(21) Appl. No.: 09/366,205

(22) Filed: Aug. 4, 1999

(30) Foreign Application Priority Data

Aug. 5, 1998 (JP) ..... 10-222131
Aug. 5, 1998 (JP) ..... 10-222134

(51) Int. Cl.[7] ..... F02D 11/10; F02D 41/22
(52) U.S. Cl. ..... 123/396; 123/399
(58) Field of Search ..... 123/361, 396, 123/399, 479, 198 D; 73/118.1; 701/114

(56) References Cited

U.S. PATENT DOCUMENTS 5,429,092 * 7/1995 Kamei ..... 123/399
5,447,134 * 9/1995 Yokoyama ..... 123/399
5,553,581 * 9/1996 Hirabayashi et al. ..... 123/399
5,602,732 * 2/1997 Nichols et al. ..... 123/399 X
5,669,353 * 9/1997 Shirai et al. ..... 123/399
5,823,164 * 10/1998 Seki et al. ..... 123/399 X
5,950,597 * 9/1999 Kamio et al. ..... 123/399 X
5,983,859 * 11/1999 Bruedigam et al. ..... 123/396
5,999,875 * 12/1999 Bruedigam et al. ..... 123/399 X
6,073,610 * 6/2000 Matsumoto et al. ..... 123/399 X

FOREIGN PATENT DOCUMENTS 7-180570 7/1995 (JP) .

* cited by examiner

*Primary Examiner*—Tony M. Argenbright
(74) *Attorney, Agent, or Firm*—McDermott, Will & Emery

(57) ABSTRACT

In a method and apparatus for fail-safe controlling an electronically-controlled throttle-type internal combustion engine, provision is made of two accelerator position sensors and two throttle position sensors. When either one of the two accelerator position sensors or either one of the two throttle position sensors fails to operate, a low-speed fail-safe operation of a minimum compensation, that is, an operation for maintaining a minimum output required for limp-home control operation of the engine, is executed and, then, a first fail-safe control operation is executed for controlling the position of the throttle valve using a value detected by the remaining sensor. Therefore, the throttle valve is not unintentionally opened, and the operation can be smoothly shifted to the first fail-safe control operation. When the operation for decelerating the engine is detected by a sensor of a system separate from the above-mentioned sensors, the first fail-safe control operation is interrupted and, instead, a second fail-safe control operation is executed for holding the throttle valve at a predetermined position in order to assure the low-speed fail-safe operation of the minimum compensation.

24 Claims, 10 Drawing Sheets

METHOD AND APPARATUS FOR FAIL SAFE CONTROL OF AN ELECTRONICALLY CONTROLLED THROTTLE VALVE OF AN INTERNAL COMBUSTION ENGINE

BACKGROUND OF THE INVENTION

1. Field of the Invention

The present invention relates to an internal combustion engine equipped with an electronically controlled throttle system opened and closed by an actuator in order to accomplish a target position of the throttle valve disposed in an intake system and, particularly, to fail-safe control technology at a time when the sensors constituting the system become abnormal.

2. Related Art of the Invention

There has been proposed an electronically-controlled throttle system for electronically controlling the position of the throttle valve to obtain a target air quantity based on the position of the accelerator (depressed amount of the accelerator pedal) or on the position of the accelerator and the engine rotation speed (see Japanese Unexamined Patent Publication No. 7-180570).

Among such electronically controlled throttle systems, in case the drive system fails to operate, those (fully electronically-controlled throttle systems) without a limp-home mechanism for mechanically linking the throttle valve by the accelerator operation through a wire employ the below-mentioned system.

That is, provision is made of two accelerator position sensors and two throttle position sensors. As for the position of the accelerator, the smaller value is selected between the two detection values (to prevent the output from becoming excessive). As for the position of the throttle valve, the detection value of the main throttle position is used and, depending upon the cases, the larger value is selected between the two detection values (selecting the larger value effects the correction toward the decreasing side due to the feedback control, and prevents the excessive output).

In case one of the two accelerator position sensors or one of the two throttle position sensors fails to operate, the output from the actuator is stopped, and the throttle valve is linked between two springs (return spring and default spring) and is held at a predetermined default position at which these springs are balanced, in order to maintain a so-called limp-home state (low-speed fail-safe operation of a minimum compensation capable of traveling with the minimum output). In case the one sensor fails to operate, if the throttle valve position is controlled using the remaining sensor, there may take place acceleration or deceleration due to the unintended opening/closing operation of the throttle valve in case the remaining sensor also fails to operate.

According to the fail-safe system in the above-mentioned fully electronically-controlled throttle system, however, if the one sensor fails to operate, the throttle valve is forcibly maintained the fail-safe position at least at that moment without utilizing the value detected by the remaining normal sensor, causing such an inconvenience that the travelling can only be performed at, for example, 40 kilometers/hour at the fastest.

Besides, among the parts constituting the electronically-controlled throttle system, the accelerator position sensor and the throttle position sensor are likely to fail to operate. It has, therefore, been demanded to guarantee traveling performance of some degree at a time of single-failure of these sensors.

The present invention was accomplished by giving attention to the above-mentioned problem inherent in the prior art, and has an object of controlling the operation at a desired speed (fail-safe control in case of single-failure=limp-home control) by using a value detected by the remaining sensor (at a time of single-failure of the sensor) if the remaining sensor is normal, while maintaining a low-speed fail-safe operation of the minimum compensation.

Another object of the invention is to smoothly take over the single-failure fail-safe control operation when the single-failure occurs in the sensor.

SUMMARY OF THE INVENTION

A first method of fail-safe controlling an electronically-controlled throttle-type internal combustion engine of the present invention comprises the steps of;

setting a target position of a throttle valve disposed in an intake system depending upon engine operation conditions inclusive of a position of an accelerator detected by one accelerator position sensor selected from two accelerator position sensors equipped to the engine;

operating the throttle valve to be opened and closed by an actuator so that a position of the throttle valve detected by one throttle position sensor selected from two throttle position sensors equipped to the engine reaches the target position;

when either one of the two accelerator position sensors or either one of the two throttle position sensors fails to operate, executing a first fail-safe control operation for controlling the position of the throttle valve by basically using a value detected by the remaining sensor; and in a state where one sensor fails to operate between the two accelerator position sensors or one sensor fails to operate between the two throttle position sensors, interrupting the first fail-safe control operation and, instead, executing a second fail-safe control operation to hold the throttle valve at a predetermined position when an operation for decelerating the engine is detected by a sensor in a system separate from the sensors.

A first apparatus for fail-safe controlling an electronically-controlled throttle-type internal combustion engine of the present invention comprises:

two accelerator position sensors for detecting a position of the accelerator;

a target position setting device for setting a target position of a throttle valve disposed in an intake system depending upon engine operation conditions inclusive of the position of the accelerator detected by one accelerator position sensor selected from the two accelerator position sensors;

two throttle position sensors for detecting a position of the throttle valve;

a throttle valve drive device for opening and closing the throttle valve using an actuator, so that the position of the throttle valve detected by one throttle position sensor selected from the two throttle position sensors reaches the target position;

a first fail-safe device which, when either one of the two accelerator position sensors or either one of the two throttle position sensors fails to operate, controls the position of the throttle valve using a value detected by the remaining sensor; and a second fail-safe device which, in a state where one sensor fails to operate between the two accelerator position sensors or one sensor fails to operate between the two throttle position sensors, interrupts the operation of the first fail-safe device and holds the throttle valve at a predetermined position when an operation for decelerating the engine is detected by a sensor in a system separate from the sensors.

According to the thus constituted first method or the first apparatus for fail-safe controlling an electronically-controlled throttle-type internal combustion engine of the present invention, when either one of the two accelerator position sensors or either one of the two throttle position sensors fails to operate, the throttle valve is usually controlled to acquire a desired target position depending upon the position of the accelerator based on a value detected by the remaining sensor to travel at a desired speed.

When the engine is decelerated by the will of the driver, on the other hand, the deceleration operation is detected by a sensor of a separate system and the throttle valve is held at a predetermined position (default position), in order to assure a double guarantee by using the sensor in the separate system in the case of a single-failure. That is, even if the remaining sensor may fail to operate, the deceleration operation makes it possible to maintain the limp-home control operation of the minimum compensation, preventing the occurrence of undesired acceleration or deceleration.

It is further allowable to use an idle switch as a sensor in the separate system, so that the deceleration operation of the engine may be detected on condition that the idling state of the engine is detected by the idle switch.

With this constitution, when the deceleration operation down to the idling state is executed by releasing an accelerator pedal, therefore, the idling switch is turned on, and the deceleration operation is detected.

It is further allowable to use a brake switch as a sensor in the separate system, so that the deceleration operation of the engine may be detected on condition that the operation of the brake is detected by the brake switch.

With this constitution, when the deceleration operation is executed by operating the brake, therefore, the brake switch is turned on, and the deceleration operation is detected.

It is of course that the deceleration operation may be detected relying upon either the idle switch is turned on or the brake switch is turned on, i.e., relying upon either the accelerator pedal is released or the brake is operated.

The second fail-safe control operation (executed by the second fail-safe control device) may interrupt the drive of the actuator, to hold the throttle valve at a predetermined position relying upon the balance of urging forces of two springs.

This enables the two springs to be expanded or contracted to control the throttle valve so as to acquire a desired position at a usual time and, when the actuator is no longer driven, the throttle valve is held at a predetermined position due to static balance of urging forces of the two springs.

Furthermore, the second fail-safe control operation (executed by the second fail-safe control device) may set the target position of the throttle valve to the predetermined position to hold the throttle valve at the predetermined position by driving the actuator.

With this constitution, when the deceleration operation is effected when the single-failure occurs in the sensor, the target position of the throttle valve is set to a predetermined position to hold the throttle valve at the predetermined position due to the actuator that is driven. In a constitution in which the throttle valve is held at a predetermined position relying upon a static balance of the urging forces of the two springs by interrupting the power supply to the actuator, it is allowable to combine therewith a constitution in which the target position is set to the predetermined position. When returned to normal state, the target position of the throttle valve at that moment is in correspondence with the predetermined position. Therefore, the target position may be changed as an initial value to prevent the position of the throttle valve from sharply changing.

Either one of the two accelerator position sensors or either one of the two throttle position sensors may be determined to be in failure when the failure state of the sensor continues for a predetermined period of time.

This eliminates the transient failure of the sensor and makes it possible to execute the first fail-safe control operation or the second fail-safe control operation only when the failure state of the sensor continues.

A second method of fail-safe controlling an electronically-controlled throttle-type internal combustion engine of the present invention comprises the steps of;

setting a target position of a throttle valve disposed in an intake system depending upon engine operation conditions inclusive of a position of an accelerator detected by one accelerator position sensor selected from two accelerator position sensors equipped to the engine;

operating the throttle valve to be opened and closed by an actuator so that a position of the throttle valve detected by one throttle position sensor selected from two throttle position sensors equipped to the engine reaches the target position;

when either one of the two accelerator position sensors or either one of the two throttle position sensors fails to operate, executing a low-speed fail-safe operation of a minimum compensation, that is, an operation maintaining a minimum output required for a limp-home control operation of the engine, after the one sensor has been determined to be in failure; and after executing the low-speed fail-safe operation of the minimum compensation, executing a single-failure fail-safe control operation to control the position of the throttle valve by using a value detected by the remaining sensor.

A second apparatus for fail-safe controlling an electronically-controlled throttle-type internal combustion engine of the present invention comprises:

two accelerator position sensors for detecting a position of an accelerator;

a target position setting device for setting a target position of a throttle valve disposed in an intake system depending upon engine operation conditions inclusive of the position of the accelerator detected by one accelerator position sensor selected from the two accelerator position sensors;

two throttle position sensors for detecting a position of the throttle valve;

a throttle valve drive device for opening and closing the throttle valve using an actuator, so that a position of the throttle valve detected by one throttle position sensor selected from the two throttle position sensors reaches the target position;

a single-failure fail-safe device which, when either one of the two accelerator position sensors or either one of the two throttle position sensors fails to operate, controls the position of the throttle valve using a value detected by the remaining sensor; and a single-failure fail-safe permission device which permits the operation of the single-failure fail-safe device when a low-speed fail-safe operation of a minimum compensation, that is, an operation maintaining a minimum output required for a limp-home control operation of the engine, is executed after the one of the two accelerator position sensors or the one of the two throttle position sensors has been determined to be in failure.

According to the thus constituted second method or second apparatus for fail-safe controlling an electrically-controlled throttle-type internal combustion engine of the present invention, when one of the two accelerator position sensors or one of the two throttle position sensors fails to operate, it is allowed to travel at a desired speed by controlling the throttle valve to a desired target position relying upon the position of the accelerator using a value detected by the remaining sensor by basically executing the single-failure fail-safe control operation (which is executed by the single-failure fail-safe device).

Here, however, if the single-failure fail-safe control operation is executed simultaneously with the determination of the single-failure of the sensor, for example when the single-failure occurs in the sensor in a state where the accelerator remains opened during traveling, since there may be phenomena that the throttle valve once closes until the single-failure is determined and opens again to a position corresponding to the accelerator position simultaneously with the determination of the single-failure, a change in output becomes large and the driver may feel it uneasy.

Therefore, after the single-failure of the sensor is detected, the driver is allowed to execute and confirm the low-speed fail-safe operation of the minimum compensation (by the single-failure fail-safe permission device), and the operation of the single-failure fail-safe device is permitted from this state, so that the operation at a desired speed corresponding to the accelerator work can be carried out. This permits the driver to make sure that the low-speed fail-safe operation of the minimum compensation is carried out, and at the same time makes it possible to avoid an increase in the output caused by an unexpected increase in the throttle position as described above.

It is also possible to so constitute the low-speed fail-safe operation of the minimum compensation to be the one in a state where the throttle valve, after the accelerator pedal is released, is near a predetermined position for compensating the fail-safe operation.

With this constitution, if the driver shows an intention of deceleration operation by releasing his foot from the accelerator pedal after the occurrence of the single-failure, he is allowed to execute and confirm the low-speed stable travelling in a state where the throttle valve is near the predetermined position for compensating the fail-safe operation of the minimum compensation. The operation is then smoothly shifted to the single-failure limp-home control operation, and the driver is allowed to travel at a desired speed depending upon the position of the accelerator.

It is also possible to so constitute the fail-safe operation of the minimum compensation to be the one in a state where the throttle valve, after the brake is operated, is near a predetermined position for compensating the fail-safe operation.

With this constitution, if the driver shows an intention of deceleration operation by operating the brake after the occurrence of the single-failure, he is allowed to execute and confirm the low-speed travelling in a state where the throttle valve is near the predetermined position for compensating the fail-safe operation of the minimum compensation. The operation is then smoothly shifted to the single-failure limp-home control operation, and the driver is allowed to travel at a desired speed depending upon the position of the accelerator.

Furthermore, the constitution may be such that when the actuator is no longer operated, the throttle valve is held at a predetermined position for compensating the low-speed fail-safe operation of the minimum compensation relying upon a balance of urging forces of two springs.

With this constitution, the throttle valve may be controlled to a desired position by expanding or contracting the two springs at a usual time. When the actuator is no longer operated, the throttle valve is held at the predetermined position due to a static balance of urging forces of the two springs to execute the low-speed fail-safe operation of the minimum compensation.

The one sensor of the two accelerator position sensors or the one sensor of the two throttle position sensors may be determined to be in failure when the failure state of the one sensor continues for a predetermined period of time.

This eliminates the transient failure of the sensor and makes it possible to determine the continuous failure.

A third method of fail-safe controlling an electronically-controlled throttle-type internal combustion engine of the present invention comprises the steps of;

setting a target position of a throttle valve disposed in an intake system depending upon engine operation conditions inclusive of a position of an accelerator detected by one accelerator position sensor selected from two accelerator position sensors equipped to the engine;

operating the throttle valve to be opened and closed by an actuator so that a position of the throttle valve detected by one throttle position sensor selected from two throttle position sensors equipped to the engine reaches the target position;

when either one of the two accelerator position sensors or either one of the two throttle position sensors fails to operate, executing a low-speed fail-safe operation of a minimum compensation, that is, an operation for maintaining a minimum output required for limp-home control operation of the engine, after the one sensor has been determined to be in failure;

after the low-speed fail-safe operation of the minimum compensation has been executed, executing a first fail-safe control operation for controlling the position of the throttle valve by using a value detected by the remaining sensor that is normal between the two sensors; and in a state where one sensor fails to operate between the two accelerator position sensors or one sensor fails to operate between the two throttle position sensors, interrupting the first fail-safe control operation and, instead, executing a second fail-safe control operation to hold the throttle valve at a predetermined position when an operation for decelerating the engine is detected by a sensor in a system separate from the sensors.

A third apparatus for fail-safe controlling an electronically-controlled throttle-type internal combustion engine of the present invention comprises:

two accelerator position sensors for detecting a position of an accelerator;

a target position setting device for setting a target position of a throttle valve disposed in an intake system depending upon engine operation conditions inclusive of the position of the accelerator detected by one accelerator position sensor selected from the two accelerator position sensors;

two throttle position sensors for detecting a position of the throttle valve;

a throttle valve drive device for opening and closing the throttle valve using an actuator, so that a position of the throttle valve detected by one throttle position sensor selected from the two throttle position sensors reaches the target position;

a first fail-safe device which, when either one of the two accelerator position sensors or either one of the two throttle position sensors fails to operate, controls the position of the throttle valve using a value detected by the remaining sensor;

a first fail-safe permission device for permitting the operation of the first fail-safe device after executing a low-speed fail-safe operation of a minimum compensation, that is, an operation for maintaining a minimum output required for limp-home control operation of the engine, after the determination of one of the two sensors to be in failure; and a second fail-safe device which, in a state where one sensor fails to operate between the two accelerator position sensors or one sensor fails to operate between the two throttle position sensors, interrupts the operation of the first fail-safe device and, instead, holds the throttle valve at a predetermined position when an operation for decelerating the engine is detected by a sensor in a system separate from the sensors.

According to the thus constituted third method and the third apparatus for fail-safe controlling an electrically-controlled throttle-type internal combustion engine of the present invention, when a single-failure occurs in the accelerator position sensor or in the throttle position sensor, the operation may be performed at a desired speed by controlling the throttle valve to assume a desired target position relying upon the value detected by the remaining sensor after executing the low-speed fail-safe operation of the minimum compensation. Therefore, if it may happen that the remaining sensor fails to operate, too, then, the limp-home control operation of the minimum compensation is assured by executing the deceleration operation.

EMBODIMENTS

Figure 1:
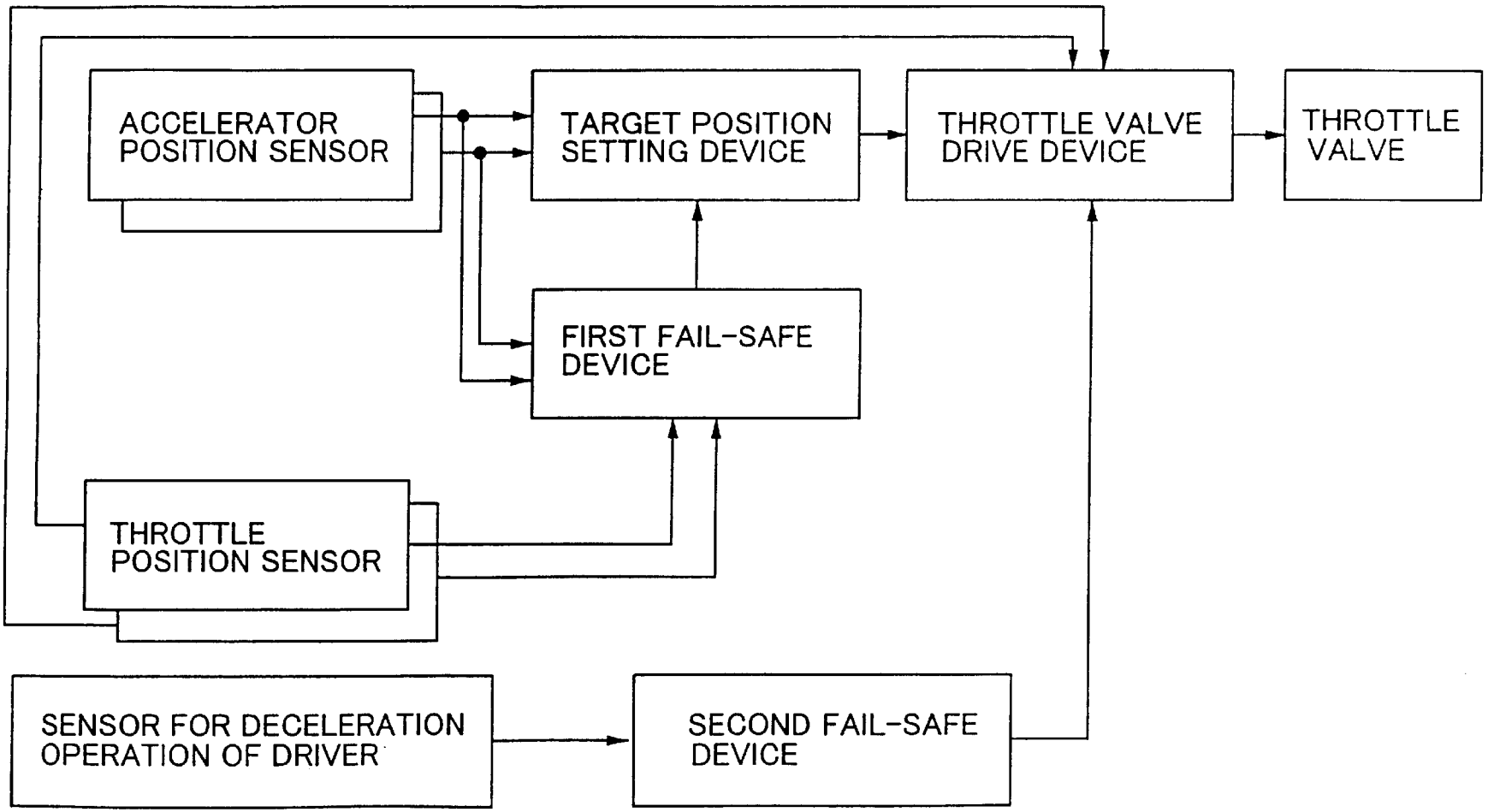
FIG. 1 is a block diagram illustrating the constitution and functions of a first apparatus of the present invention.

A first apparatus for fail-safe controlling an electronically-controlled throttle-type internal combustion engine according to the present invention comprises devices shown in FIG. 1.

Two accelerator position sensors are provided to detect a position of an accelerator, respectively.

A target position-setting device sets a target position of a throttle valve disposed in an intake system depending upon engine operation conditions inclusive of the position of the accelerator detected by one accelerator position sensor selected from the two accelerator position sensors.

Two throttle position sensors are provided to detect a position of the throttle valve, respectively.

A throttle valve drive device opens and closes the throttle valve by using an actuator, so that the position of the throttle valve detected by one throttle position sensor selected from the two throttle position sensors reaches the target position.

When either one of the two accelerator position sensor or of the throttle position sensors fails to operate, a first fail-safe device controls the position of the throttle valve by using a value detected by the remaining sensor.

When either one of the two accelerator position sensors or of the throttle position sensors fails to operate and when the operation for decelerating the engine is detected by a sensor of a system separate from the above-mentioned sensors, a second fail-safe device interrupts the operation of the first fail-safe device and, instead, holds the throttle valve at a predetermined position.

Figure 2:
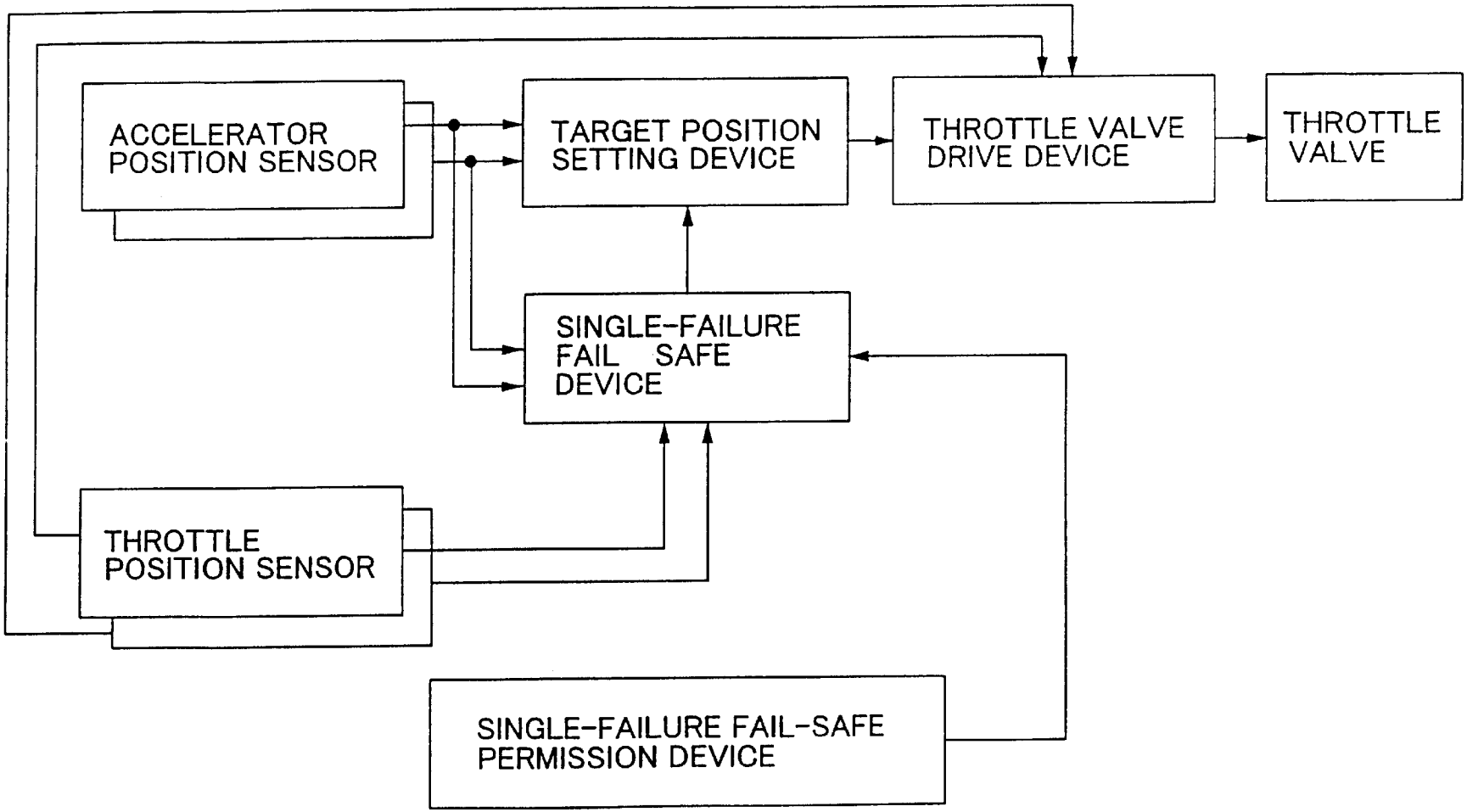
FIG. 2 is a block diagram illustrating the constitution and functions of a second apparatus of the present invention.

A second apparatus for fail-safe controlling an electronically-controlled throttle-type internal combustion engine according to the present invention comprises devices shown in FIG. 2.

Accelerator position sensors, throttle position sensors and throttle valve drive device are the same as those in the above-mentioned first apparatus, and a single-failure fail-safe device exhibits the same function as the first fail-safe device in the first apparatus.

A single-failure fail-safe permission device permits the operation of the single-failure fail-safe device after executing a low-speed fail-safe operation of a minimum compensation, that is, an operation for maintaining a minimum output required for limp-home control operation of the engine, after the determination of one of the two accelerator position sensors to be in failure or after the determination of one of the two throttle position sensors to be in failure.

Figure 3:
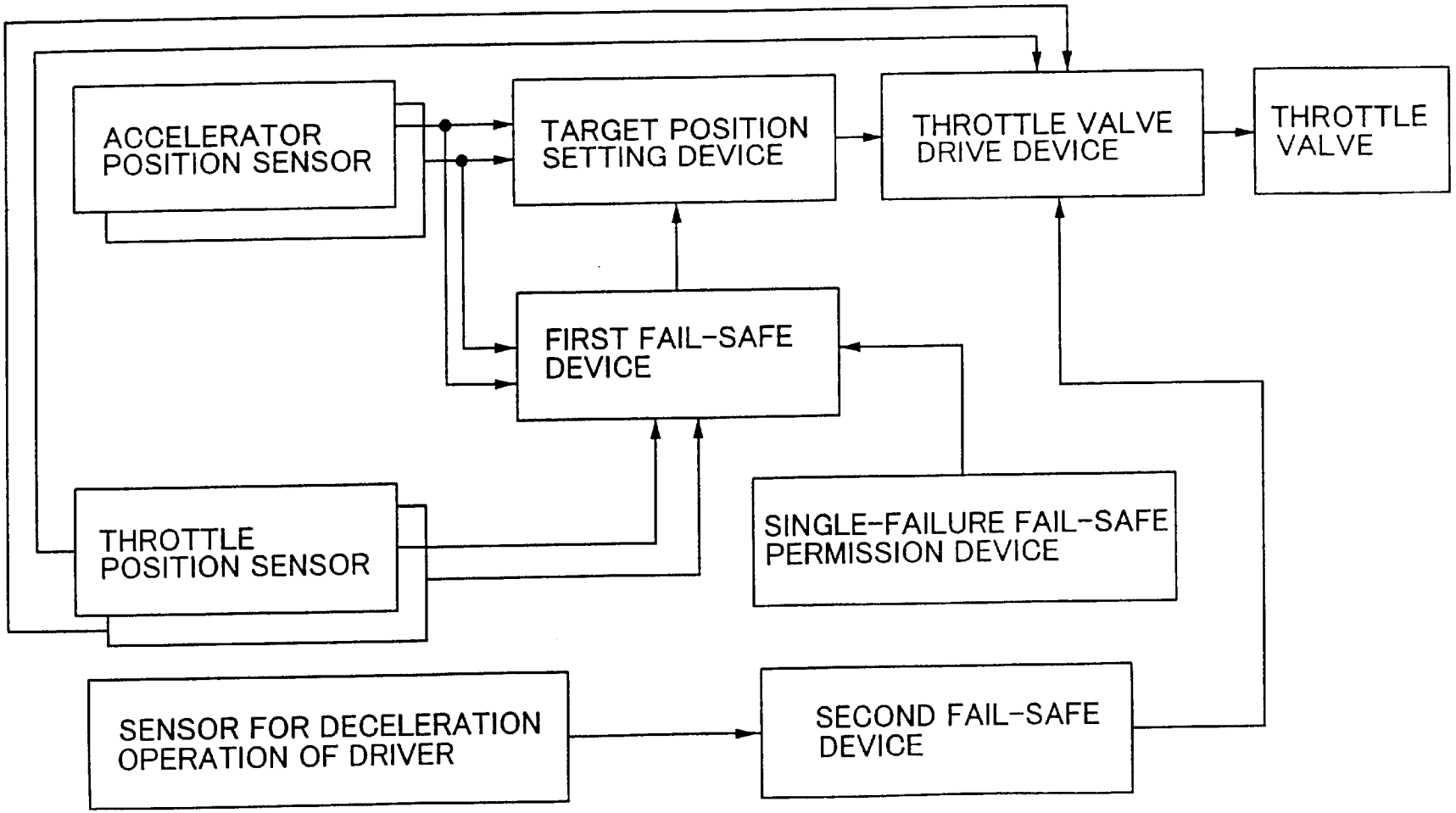
FIG. 3 is a block diagram illustrating the constitution and functions of a third apparatus of the present invention.

A third apparatus for fail-safe controlling an electronically-controlled throttle-type internal combustion engine according to the present invention comprises devices shown in FIG. 3.

The third apparatus is constituted by a combination of the constitution of the first apparatus and that of the second apparatus. A first fail-safe permission device exhibits a function same as that of the single-failure fail-safe permission device of the second apparatus, and permits the operation of the first fail-safe device after executing the low-speed fail-safe operation of the minimum compensation after the determination of one of the two accelerator position sensors to be in failure or after the determination of one of the two throttle position sensors to be in failure.

Next, embodiments of the present invention will be described with reference to the drawings.

Figure 4:
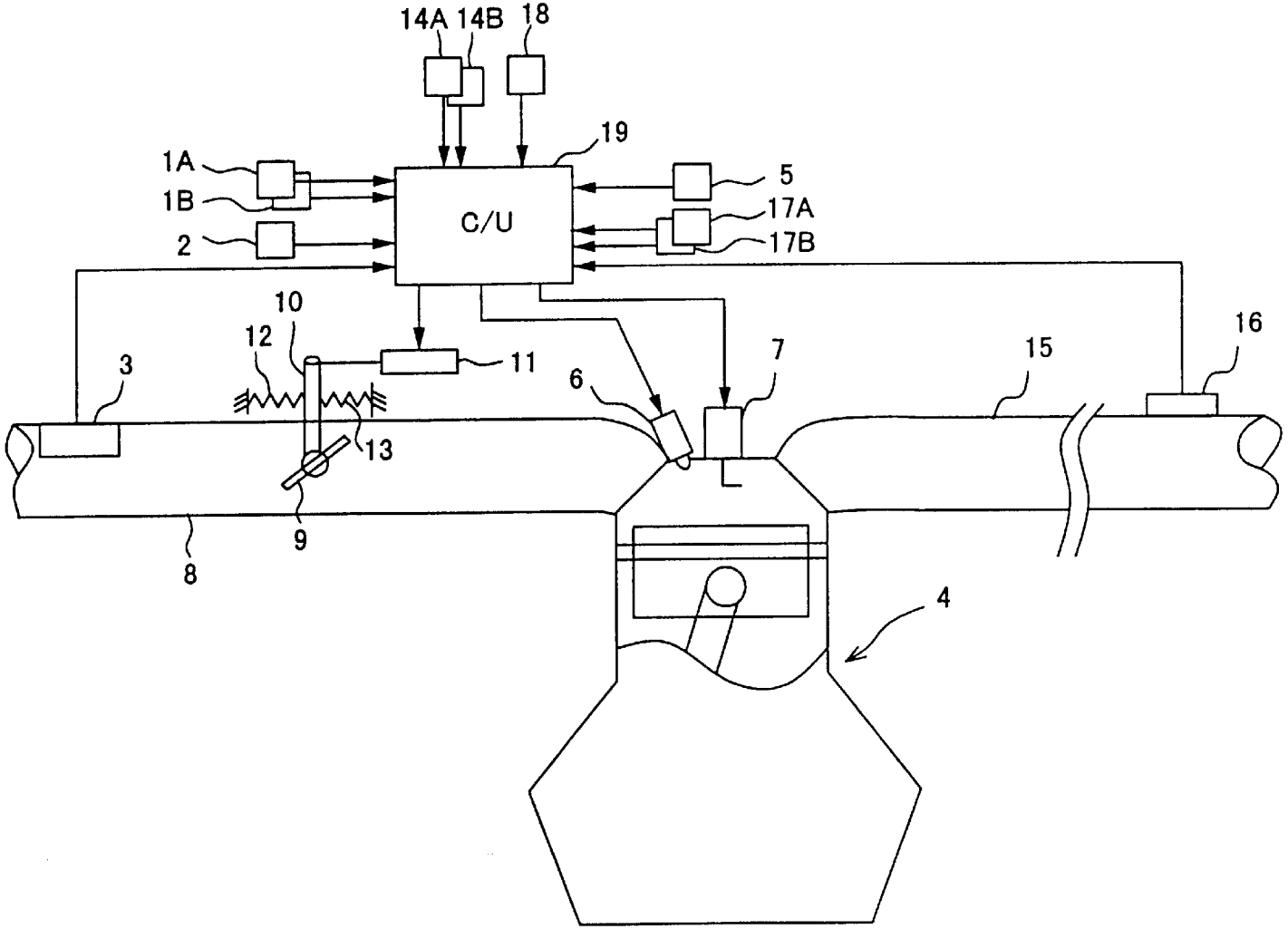
FIG. 4 is a diagram illustrating the system structure of an embodiment common to the first to third methods and apparatuses of the present invention.

FIG. 4 illustrates the constitution of a system structure of an embodiment common to the first to third methods and apparatus for fail-safe controlling an electronically controlled throttle-type internal combustion engine according to the present invention.

Two accelerator position sensors (APS) 1A and 1B detect the depressed amount of an accelerator pedal (accelerator position) depressed by the driver.

A crank angle sensor 2 generates a position signal for every unit crank angle and a reference signal for every phase difference in the cylinder stroke. The rotation speed of the engine is detected by measuring the number of the position signals generated per a unit time or by measuring the period for generating the reference signal.

An air flow meter 3 detects an intake air quantity (intake air quantity per a unit time=intake air flow rate) taken in by an internal combustion engine 4.

A water temperature sensor 5 detects the cooling water temperature of the engine.

The engine 4 is provided with a fuel injection valve 6 that is driven by a fuel injection signal to inject and supply fuel directly into a combustion chamber, and an ignition plug 7 mounted in the combustion chamber to effect the ignition. The system for directly injecting fuel into the combustion chamber makes it possible to accomplish a lean stratified charge combustion and to variably control an air-fuel ratio over a wide range.

A throttle valve 9 is disposed in an intake passage 8 of the engine 4, and an actuator 11 is provided for electronically controlling a position of the throttle valve 9 through a lever 10 coupled to the valve shaft. A return spring 12 and a default spring 13 are coupled to the lever 10. In a state where the power supply to the actuator 11 is stopped, the throttle valve 9 is held at a predetermined default position at where the urging forces of the return spring 12 and the default spring 13 are balanced. The throttle valve 9 is provided with two throttle position sensors 14A and 14B for detecting the position of the throttle valve 9.

An exhaust passage 15 is provided with an air-fuel ratio sensor 16 that works as an air-fuel ratio detection device for detecting an air-fuel ratio of the combustion mixture by detecting a particular component such as oxygen concentration in the exhaust gases.

In order to detect the deceleration operation by the driver, furthermore, idle switches 17A and 17B for detecting the idling condition (state where the accelerator pedal is released) are provided accompanying the accelerator position sensors 1A and 1B. Besides, a brake switch 18 is provided for detecting the operation of the brake.

Detection signals from these sensors are input to a control unit 19. Depending upon the operation conditions detected based on the signals from these sensors, the control unit 19 drives the actuator 11 to control the position of the throttle valve 9, drives the fuel injection valve 6 to control the fuel injection quantity (fuel supply quantity), and sets the ignition timing so that the ignition is accomplished by the ignition plug 7 at the ignition timing.

Figure 5:
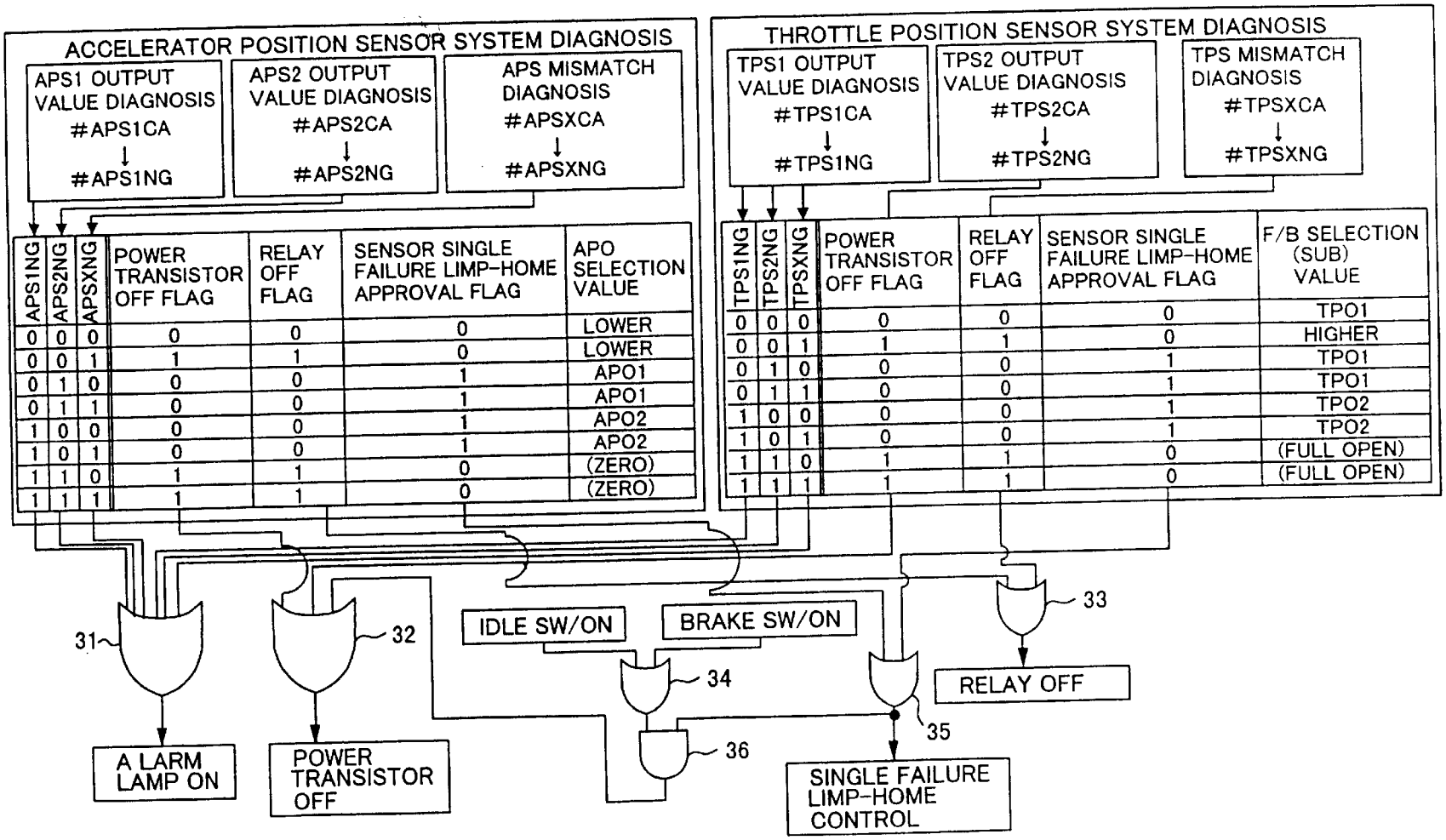
FIG. 5 is a circuit block diagram illustrating the control of the throttle valve based on the diagnosis of the accelerator position sensors and the throttle position sensors according to a first embodiment of the first method and first apparatus of the present invention.

Next, described below with reference to FIG. 5 is a failure diagnosis for the accelerator position sensors 1A(APS1), 1B(APS2) and for the throttle position sensors 14A, 14B, and the fail-safe control operation during failure.

Described below with reference to FIG. 5 is the diagnosis for the accelerator position sensor system. In diagnosing the output of the accelerator position sensor 1A(1B), failure such as open circuit or short-circuit is detected. When the sensor fails to operate, the flag APS1CA(APS2CA) is set to 1. To eliminate transient failure, the flag APS1NG (APS2NG) is set to 1 when the failure state continues for a predetermined delay time, and the accelerator position sensor 1A(1B) is determined to be in failure. When the flags (inclusive of flags that will be described later) are set to 1, the output to the circuits that will be described later is set to be a high level. When the flags are reset to 0, the output to the circuits assumes a low level.

It is further diagnosed if the accelerator position sensors 1A and 1B are not in match with each other, creating a large difference (diagnosis of APS mismatching). When they are not in match, the flag APSXCA is set to 1. In this case, too, to eliminate transient mismatch, the flag APSXNG is set to 1 when the mismatch state continues for a predetermined delay time, and the accelerator position sensors 1A and 1B are determined to be mismatching. When a single-failure occurs in the sensor, a difference increases in the output values between the failure side and the normal side. Therefore, the mismatch state is determined, first, and, then, the single-failure is determined.

The diagnosis of the throttle position sensor system is the same as the case of the diagnosis of the accelerator position sensor system. That is, failure such as open circuit or short-circuit of the throttle position sensor 14A(14B) is detected. When the sensor fails to operate, the flag TPS1CA (TPS2CA) is set to 1. When the failure state continues for a predetermined delay time, the flag TPS1NG(TPS2NG) is set to 1 to determine that the throttle position sensor 14A(14B) fails to operate. When the throttle position sensors 14A and 14B are not in match creating a large difference, the flag TPSXCA is set to 1. When the mismatch state continues for a predetermined delay time, the flag TPSXNG is set to 1 to determine that the throttle position sensors are not in match with each other. After the sensors are determined to be out of match, the single-failure is determined in the same manner as described above.

As for the accelerator position sensor system, when the three flags APS1NG, APS2NG and APSXNG are all 0 (first row on the table of this system), i.e., when the diagnosed results of the accelerator position sensor system are all normal, the smaller value is selected (LOWER) between the two values detected by the accelerator position sensors 1A and 1B. As for the throttle position sensor system, when the three flags TPS1NG, TPS2NG and TPSXNG are all 0 (first row on the table of this system), a value TPO1 detected by one throttle position sensor 14A is selected.

When these systems are diagnosed to be all normal, no limp-home control operation is required. Therefore, a sensor single-failure limp-home permission flag is set to 0, a power-transistor off flag and a relay off flag are set to 0. When the two systems are all normal, therefore, a power transistor for driving the actuator and a drive relay are both turned on, and the actuator 11 is operated, and the position of the throttle valve 9 is so controlled as to acquire a predetermined target throttle valve position set based on the accelerator position APO of the smaller side. In this case, furthermore, since the output of a first OR circuit 31 is maintained at the low level, an alarm lamp is not turned on.

When the mismatch flag APSXCA(TPSXCA) only is set (second row on the table of the system) for at least either one system, furthermore, it is judged that the values detected by the accelerator position sensors 1A and 1B (throttle position sensors 14A and 14B) are not reliable, and the power transistor off flag and the relay off flag are set to 1. Then, the first OR circuit 31 produces an output of high level to turn the alarm lamp on. Besides, a second OR circuit 32 and a third OR circuit 33 produce outputs of high level to turn off both the power transistor for driving the actuator and the drive relay, whereby no power is supplied to the actuator 11, and the throttle valve 9 is held at a default position at where the urging forces of the return spring 12 and the default spring 13 are balanced, to travel at a required minimum speed (e.g., 40 km/h). When at least any one of the six flags APS1NG, APS2NG, APSXNG, TPS1NG, TPS2NG and TPSXNG is 1, the first OR circuit 31 produces an output of high level to turn the alarm lamp on as will be described below.

Next, when either one of the flag APS1NG or APS2NG (TPS1NG or TPS2NG) is 1, i.e., when it is so diagnosed that either one of the accelerator position sensor 1A or 1B (throttle position sensor 14A or 14B fails to operate (single-failure) in each system (third to sixth rows on the table of the systems), the power transistor off flag and the relay off flag are set to 0, and the sensor single-failure limp-home permission flag is set to 1. As for the accelerator position APO (throttle position TPO), a value of the side diagnosed to be normal is selected, i.e., APS1 or APS2 (TPO1 or TP02) is selected.

When either one of the accelerator position sensor system or the throttle position sensor system is quite normal but the single-failure occurs in the other one or when the single-failure occur in both of two systems, usually, the actuator 11 is operated, and the position of the throttle valve 9 is so controlled as to acquire a target position set based on the selected accelerator position APO. That is, the throttle position is not forcibly held at the default position, and it is allowed to travel at any desired speed without being limited to a low speed of about 40 km/h.

When the deceleration operation is effected by the will of the driver under the single-failure condition, however, the release of the accelerator pedal causes the idle switches 17A and 17B to be turned on, or operation of the brake causes the brake switch 18 to be turned on, whereby a fourth OR circuit 34 produces an output of high level. Besides, since either one system is under the single-failure condition, the sensor single-failure limp-home permission flag has been set to 1, and a fifth OR circuit 35 produces an output of high level. Therefore, an AND circuit 36 produces an output of high level, the second OR circuit 32 produces an output of high level, the power transistor for driving the actuator 11 is turned off, no power is supplied to the actuator 11, the throttle valve 9 is held at the default position at where the urging forces of the return spring 12 and the default spring 13 are balanced, enabling of travel of at a required minimum speed (e.g., 40 km/h).

Under the single-failure condition, therefore, a sensor of separate system can be used in combination to assure a double guarantee.

In case both of the two accelerator position sensors 1A and 1B (throttle position sensors 14A and 14B) fails to operate, the normal throttle position control is not expected. Therefore, the power transistor off flag and the relay off flag are both set to 1, and no power is supplied to the actuator, to hold the throttle valve 9 at the default position.

In this embodiment, the operation of the actuator is stopped by turning both the power transistor and the drive relay off. However, either one of them only may be turned off to simplify the constitution.

Moreover, the throttle valve 9 may be held at the default position by using either the idle switch ON signal or the brake switch ON signal.

Figure 6:
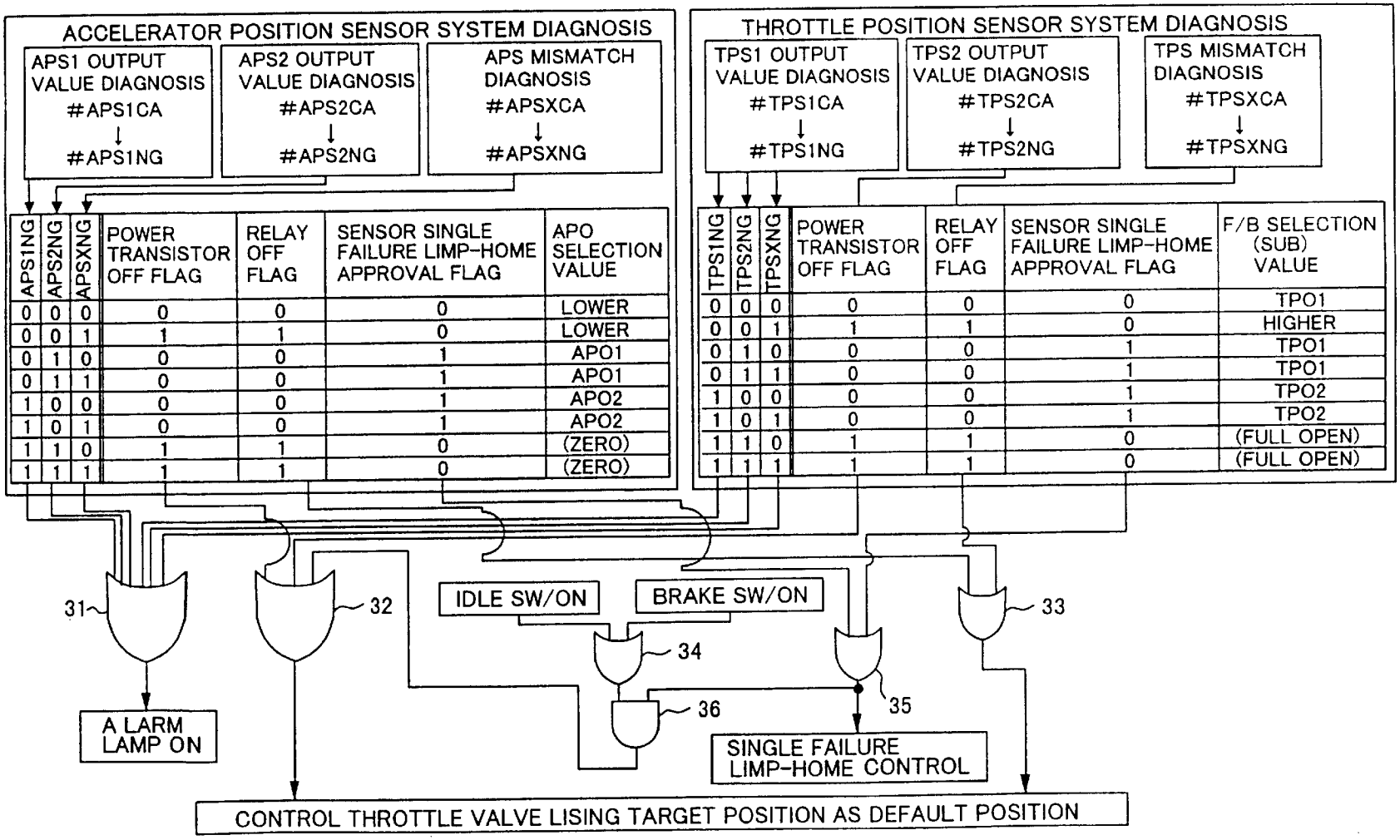
FIG. 6 is a circuit block diagram illustrating the control of the throttle valve based on the diagnosis of the accelerator position sensors and the throttle position sensors according to a second embodiment of the first method and first apparatus of the present invention.

According to a second embodiment as shown in FIG. 6, furthermore, the constitution for holding the throttle valve 9 at the default position may be such that the target position of the throttle valve is used as the default position instead of interrupting the power to the actuator and the actuator is operated to maintain the throttle valve at the default position. Moreover, the first embodiment and the second embodiment may be combined together so that, when the throttle valve control returns to the normal state after the power supply to the actuator is stopped, the target position of the throttle valve is used as the default position, thereby to prevent the position of the throttle valve from sharply changing.

Next, embodiments of the failure diagnosis for the accelerator position sensors 1A(APS1), 1B(APS2) and the throttle-position sensors 14A, 14B and the fail-safe control operation during failure according to the second method and the second apparatus of the present invention will be described with reference to FIGS. 7 and 8.

Figure 7:
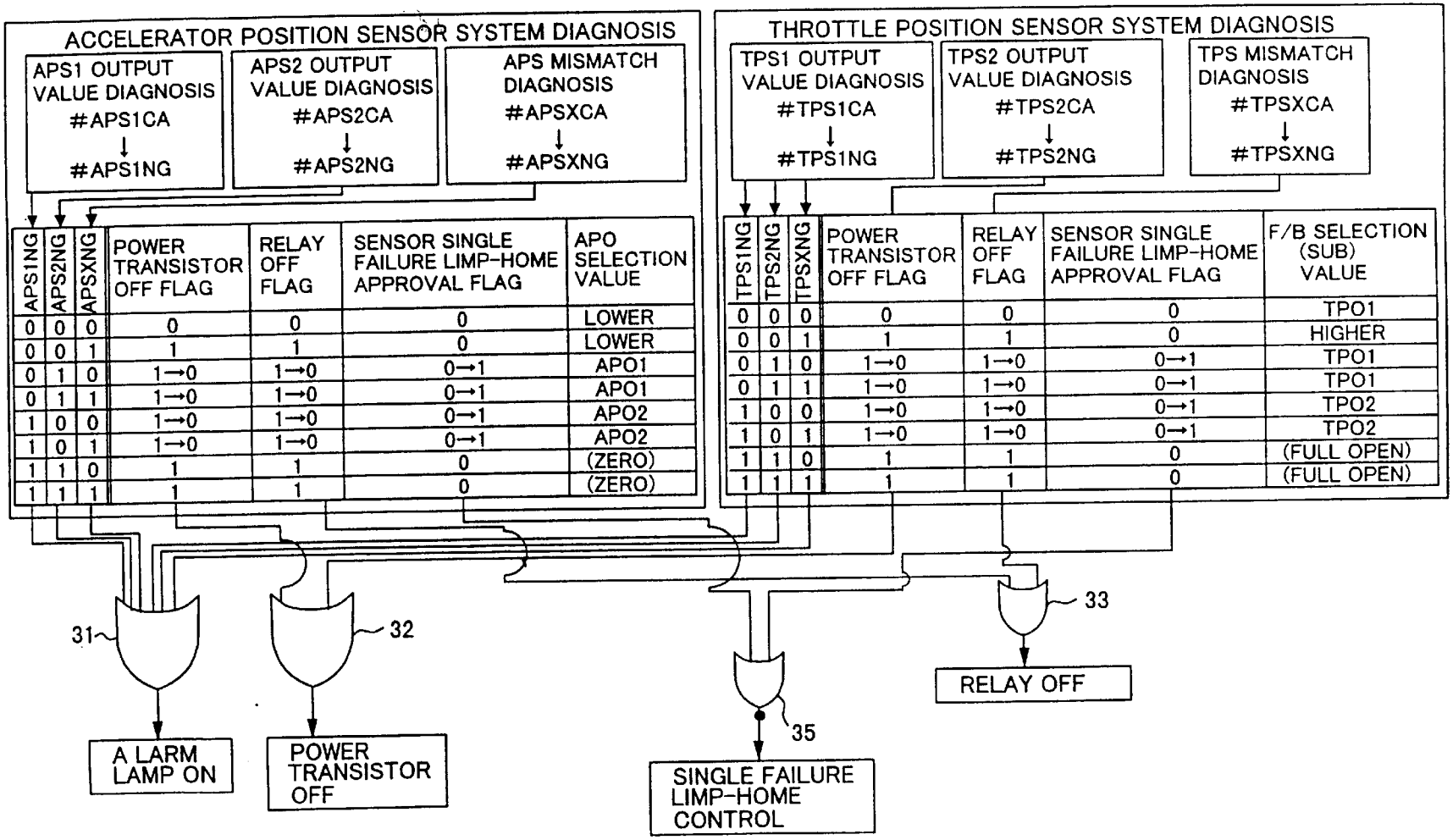
FIG. 7 is a circuit block diagram illustrating the control of the throttle valve based on the diagnosis of the accelerator position sensors and the throttle position sensors according to an embodiment of the second method and second apparatus of the present invention.

Comparing the circuit block diagram of FIG. 7 with that of FIG. 5 illustrating the embodiment the first method and the first apparatus, when it is so diagnosed that either one of the flag APS1NG or APS2NG (TPS1NG or TPS2NG) fails to operate, i.e., either one of the accelerator position sensor 1A or 1B (throttle position sensor 14A or 14B) fails to operate (single-failure) in each system (third to sixth rows on the table of the systems), the sensor single-failure limp-home permission flag is set to 1 from 0 after a predetermined condition that will be described later is established after the single-failure has been determined, and the power transistor off flag and the relay off flag are changed over from 1 to 0 in synchronism with the change over of the sensor single-failure limp-home permission flag from 0 to 1. Moreover, in this embodiment, the fourth OR circuit 34 in FIG. 5 for receiving signals from the idle switch and the brake switch and the AND circuit 36 in FIG. 5 for receiving signals from the fourth OR circuit 34 and the fifth OR circuit 35 are omitted. Instead, the second OR circuit 32 receives only those signals of the power transistor off flag in the accelerator position sensor system and the throttle valve position sensor system.

Therefore, this embodiment is the same as the embodiment of the first apparatus concerning the normal throttle valve position control operation at a time when the systems are all diagnosed to be normal and the single-failure limp-home control operation based on a detection value of the remaining sensor at a time when the single-failure limp-home permission flag is set to 1, but is different therefrom in that the single-failure limp-home control operation is permitted after the low-speed fail-safe operation of the minimum compensation is executed.

Figure 8:
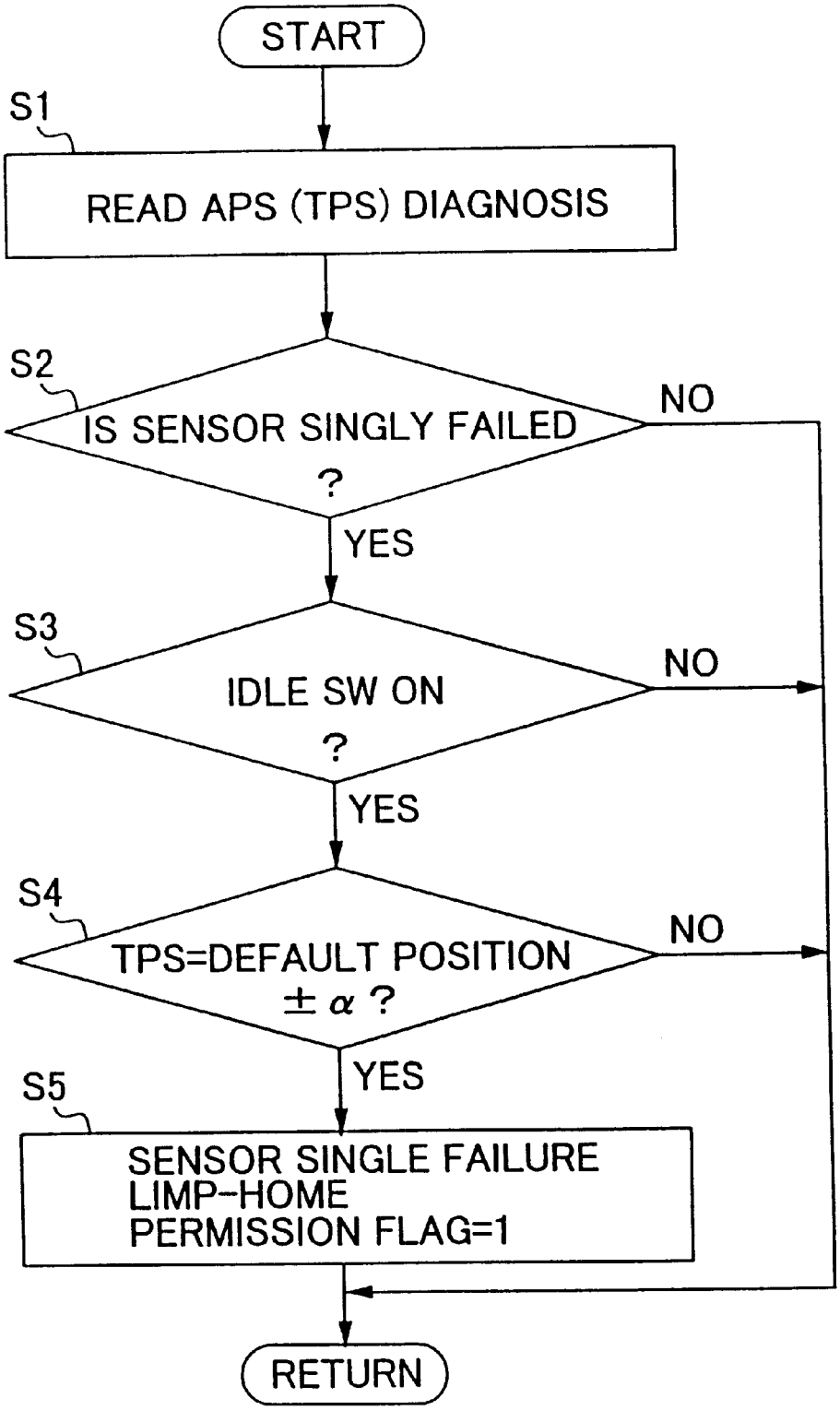
FIG. 8 is a flow chart illustrating a routine for setting a limp-home permission flag in the case of a single-failure in the sensor, which is common to the second method, second apparatus and third apparatus of the present invention.

Described below with reference to a flow chart of FIG. 8 is an embodiment of a routine for setting the single-failure limp-home permission flag to 1 after the sensor single-failure has been determined corresponding to the embodiment of the second method and the second apparatus. The accelerator position sensors and the throttle position sensors are operated in the same manner.

The diagnosed result of the accelerator position sensor (throttle position sensor) is read at step 1.

At step 2, it is judged from the values of the flags whether or not the single-failure occurs in either one of the accelerator position sensors (throttle position sensors) of one system.

When it is judged to be the single-failure, the routine proceeds to step 3 where it is judged whether the idle switch is turned on or not by the operation for releasing the accelerator pedal.

When it is judged that the idle switch is turned on, the routine proceeds to step 4 where it is judged whether the position of the throttle valve is a value near the default position (default position±α) or not.

When it is judged that the value is near the default position, the single-failure limp-home permission flag of the accelerator position sensor (throttle position sensor) is set to 1.

Figure 9:
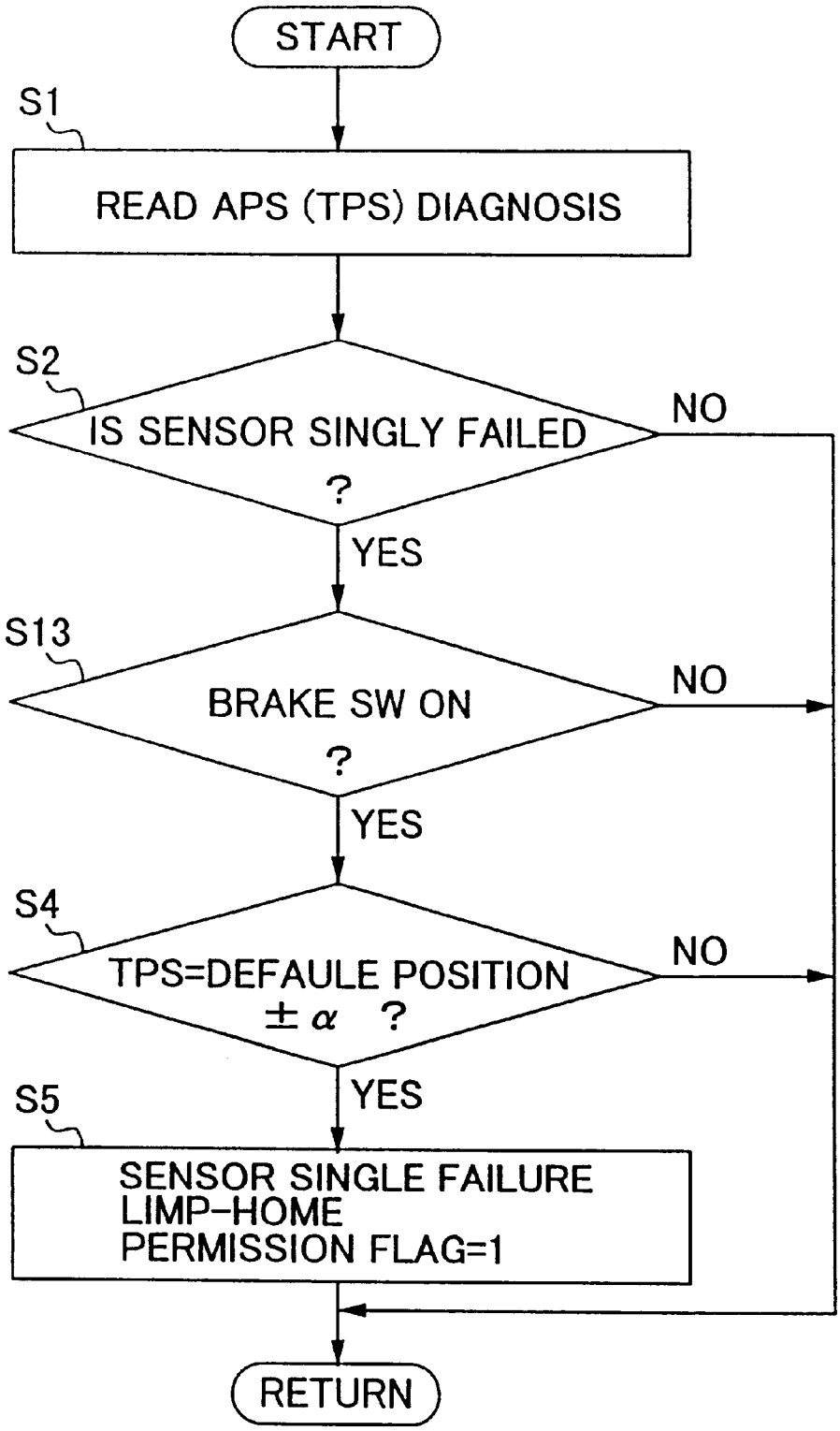
FIG. 9 is a flow chart illustrating another routine for setting a limp-home permission flag in the case of a single-failure in the sensor, which is common for the second method, second apparatus, third method and third apparatus of the present invention.

FIG. 9 illustrates another embodiment of the routine for setting the single-failure limp-home permission flag.

A difference of the embodiment of FIG. 9 from the embodiment of FIG. 8 is that it is judged at step 13 whether the brake switch is turned on or not, instead of the idle switch. However, this step renders the same judgement of detecting the driver's will for effecting the deceleration excessive of a predetermined level as the judgement in FIG. 8.

When the single-failure limp-home permission flag is set to 1 in either the accelerator position sensor system or the throttle position sensor system, the output of the fourth OR circuit 35 of FIG. 7 becomes the high level to execute the single-failure limp-home control operation. Concretely speaking, the power transistor off flag and the relay off flag are simultaneously changed over to 0, whereby the actuator 11 is operated to so control the throttle valve 9 as to acquire a target throttle position set based on the selected accelerator position APO. That is, the throttle position is not forcibly held at the default position, and it is allowed to travel at any desired speed without being limited to a low speed of, for example, 40 km/h.

As described above, furthermore, after a single-failure has occurred but before it is determined to be the single-failure, the values of the two sensors are not in match and the mismatch flag APSXCA (TPSXCA) is set to 1 and, at this moment, the relay off flag is set to 1, whereby the actuator is no longer operated, and the throttle valve is caused to move up to the default position where the return spring and the default spring are balanced. However, there is a delay to reach the default position due to the intake resistance or the mechanical delay. When the single-failure limp-home control operation is executed before the default position is reached, the throttle valve still remains opened. Therefore, the limp-home control is started from a point of a large output. When the accelerator is greatly opened, in particular, the throttle valve position further increases, producing an acceleration which is not intended by the driver.

According to the embodiment of the second method and the second apparatus, therefore, the operation is shifted to the single-failure limp-home control operation after the deceleration operation of equal to or than a predetermined level such as releasing the accelerator pedal or operating the brake is executed, and the throttle valve has really returned to near the default position to execute and confirm the low-speed fail-safe operation of the minimum compensation, so as to smoothly travel at any desired speed corresponding to the position of the accelerator intended by the driver.

Next, described below is an embodiment of the third method and the third apparatus combining the first method and first apparatus with the second method and second apparatus of the present invention.

Figure 10:
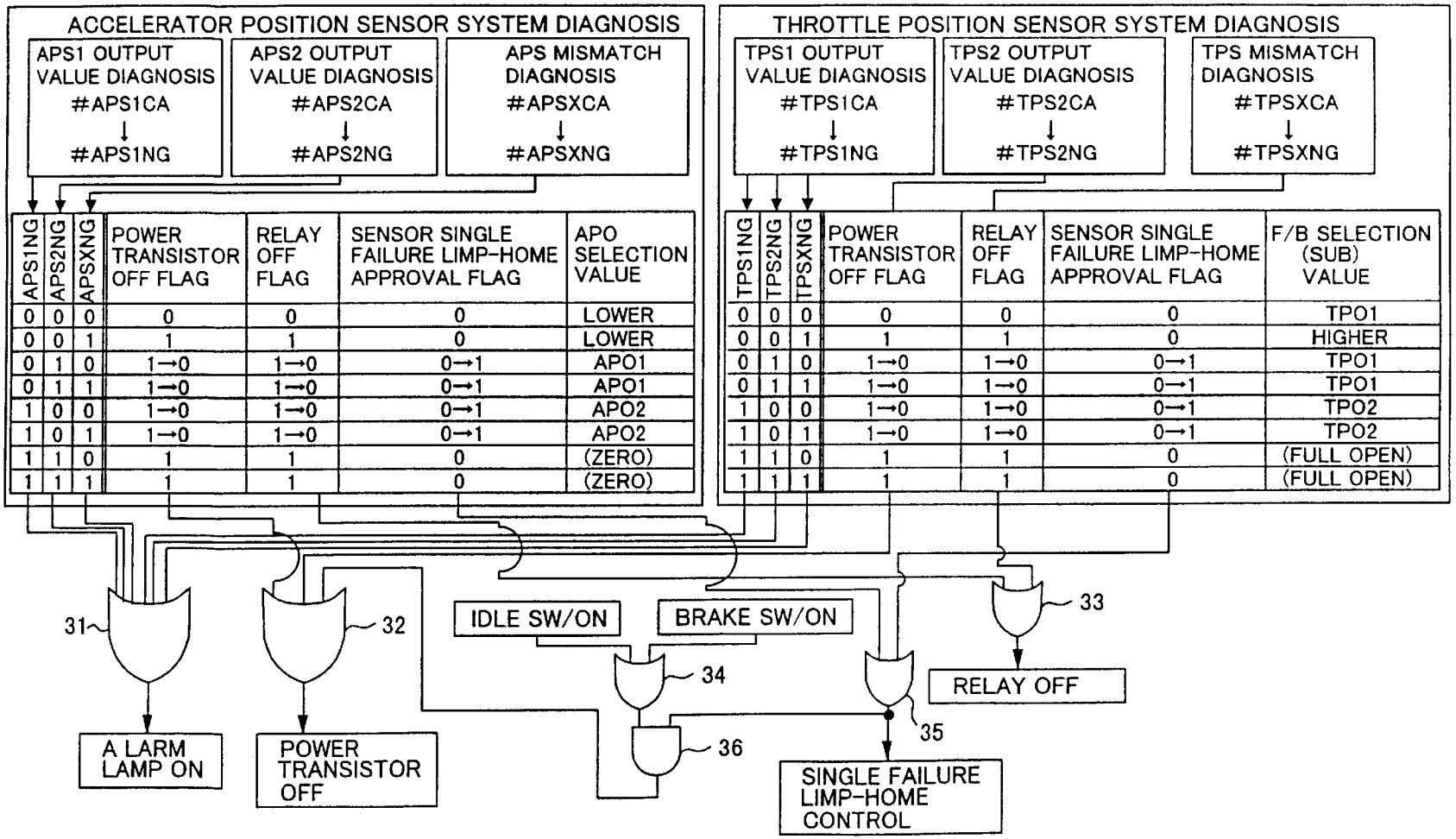
FIG. 10 is a circuit block diagram illustrating the control of the throttle valve based on the diagnosis of the accelerator position sensors and the throttle position sensors according to an embodiment of the third method and third apparatus of the present invention.

Referring to FIG. 10 which is a circuit block diagram of the this embodiment, like in the embodiment of the first method and first apparatus in FIG. 5, provision is made of a fourth OR circuit 34 for receiving signals from the idle switch and the brake switch, and an AND circuit 36 for receiving a signal from the fourth OR circuit 34 and a signal from the fifth OR circuit 35. Like in the embodiment of the second method and second apparatus shown in FIG. 7, furthermore, when it is so diagnosed that only either one of the flag APS1NG or APS2NG (TPS1NG or TPS2NG) fails to operate, i.e., only either one of the accelerator position sensor 1A or 1B (throttle position sensor 14A or 14B) fails to operate (single-failure) in the systems (third to sixth rows of the table of the systems), the sensor single-failure limp-home permission flag is set to 1 from 0 after the single-failure has been determined and after a predetermined condition that will be described later is established. Then, the power transistor off flag and the relay off flag are changed over to 1 from 0 in synchronism with the change over of the sensor single-failure limp-home permission flag from 0 to 1.

FIGS. 8 and 9 illustrating the two embodiments of the routine for setting the single-failure limp-home permission flag to 1 can be used in common for illustrating the embodiment of the third method and the third apparatus.

The embodiment of the thus constituted third method and third apparatus exhibits the effects of the first method and the first apparatus as well as of the second method and second apparatus in combination. That is, after it is confirmed that the low-speed fail-safe operation of the minimum compensation can be conducted, the single-failure limp-home control operation is permitted. Therefore, the operation can be smoothly shifted to the single-failure limp-home control operation after having assured the double compensation. Further, even in case the remaining sensor fails to operate after the single-failure limp-home control operation is permitted, the operation can be switched to the low-speed fail-safe operation of the minimum compensation by effecting the deceleration.

What we claimed are:

1. A method of fail-safe controlling an electronically-controlled throttle valve of an internal combustion engine comprising the steps of:

setting a target position of a throttle valve disposed in an intake system depending upon engine operation conditions inclusive of a position of an accelerator detected by one accelerator position sensor selected from two accelerator position sensors equipped to said engine;

operating said throttle valve to be opened and closed by an actuator so that a position of said throttle valve detected by one throttle position sensor selected from two throttle position sensors equipped to said engine reaches the target position;

when either one of said two accelerator position sensors or either one of said two throttle position sensors fails to operate, executing a first fail-safe control operation for controlling the position of said throttle valve by basically using a value detected by the remaining sensor; and in a state where one sensor fails to operate between said two accelerator position sensors or one sensor fails to operate between said two throttle position sensors, interrupting said first fail-safe control operation and, instead, executing a second fail-safe control operation to hold said throttle valve at a predetermined position when an operation for decelerating the engine is detected by a sensor in a system separate from said sensors.

2. A method of fail-safe controlling an electronically-controlled throttle valve of an internal combustion engine according to claim 1, wherein the detection of the deceleration operation of the engine by a sensor of said separate system includes a condition that the idling state of the engine is detected by an idle switch.

3. A method of fail-safe controlling an electronically-controlled throttle valve of an internal combustion engine according to claim 1, wherein the detection of the deceleration operation of the engine by a sensor of said separate system includes a condition that the operation of the brake is detected by a brake switch.

4. A method of fail-safe controlling an electronically-controlled throttle valve of an internal combustion engine according to claim 1, wherein said second fail-safe control operation interrupts the drive of said actuator, to hold the throttle valve at a predetermined position relying upon the balance of urging forces of two springs.

5. A method of fail-safe controlling an electronically-controlled throttle valve of an internal combustion engine according to claim 1, wherein said second fail-safe control operation sets the target position of the throttle valve to the predetermined position to hold the throttle valve at the predetermined position by driving the actuator.

6. A method of fail-safe controlling an electronically-controlled throttle valve of an internal combustion engine according to claim 1, wherein either one of the two accelerator position sensors or either one of the two throttle position sensors for executing said first fail-safe control operation or said second fail-safe control operation is determined to be in failure when the failure state of the sensor continues for a predetermined period of time.

7. A method of fail-safe controlling an electronically-controlled throttle valve of an internal combustion engine comprising the steps of:

setting a target position of a throttle valve disposed in an intake system depending upon engine operation conditions inclusive of a position of an accelerator detected by one accelerator position sensor selected from two accelerator position sensors equipped to said engine;

operating said throttle valve to be opened and closed by an actuator so that a position of said throttle valve detected by one throttle position sensor selected from two throttle position sensors equipped to said engine reaches the target position;

when either one of said two accelerator position sensors or either one of said two throttle position sensors fails to operate, executing a low-speed fail-safe operation of a minimum compensation, that is, an operation for maintaining a minimum output required for limp-home control operation of the engine, after said one sensor has been determined to be in failure; and after executing the low-speed fail-safe operation of the minimum compensation, executing a single-failure fail-safe control operation to control the position of the throttle valve by using a value detected by the remaining sensor.

8. A method of fail-safe controlling an electronically-controlled throttle valve of an internal combustion engine according to claim 7, wherein said low-speed fail-safe operation of the minimum compensation is the one in a state where the throttle valve, after the accelerator pedal is released, is near a predetermined position for compensating the fail-safe operation.

9. A method of fail-safe controlling an electronically-controlled throttle valve of an internal combustion engine according to claim 7, wherein said low-speed fail-safe operation of the minimum compensation is the one in a state where the throttle valve, after the brake is operated, is near a predetermined position for compensating the fail-safe operation.

10. A method of fail-safe controlling an electronically-controlled throttle valve of an internal combustion engine according to claim 7, wherein when said actuator is no longer operated, the throttle valve is held at a predetermined position for compensating the low-speed fail-safe operation of the minimum compensation relying upon a balance of urging forces of two springs.

11. A method of fail-safe controlling an electronically-controlled throttle valve of an internal combustion engine according to claim 7, wherein the one sensor of the two accelerator position sensors or the one sensor of the two throttle position sensors is determined to be in failure when the failure state of said one sensor continues for a predetermined period of time.

12. A method of fail-safe controlling an electronically-controlled throttle valve of an internal combustion engine comprising the steps of:

setting a target position of a throttle valve disposed in an intake system depending upon engine operation conditions inclusive of a position of an accelerator detected by one accelerator position sensor selected from two accelerator position sensors equipped to said engine;

operating said throttle valve to be opened and closed by an actuator so that a position of said throttle valve detected by one throttle position sensor selected from two throttle position sensors equipped to said engine reaches the target position;

when either one of said two accelerator position sensors or either one of said two throttle position sensors fails to operate, executing a low-speed fail-safe operation of a minimum compensation, that is, an operation for maintaining a minimum output required for limp-home control operation of the engine, after said one sensor has been determined to be in failure;

after the low-speed fail-safe operation of the minimum compensation has been experienced, executing a first fail-safe control operation for controlling the position of the throttle valve by using a value detected by the remaining sensor that is normal between said two sensors; and in a state where one sensor fails to operate between said two accelerator position sensors or one sensor fails to operate between said two throttle position sensors, interrupting said first fail-safe control operation and, instead, executing a second fail-safe control operation to hold said throttle valve at a predetermined position when an operation for decelerating the engine is detected by a sensor in a system separate from said sensors.

13. An apparatus for fail-safe controlling an electronically-controlled throttle valve of an internal combustion engine comprising:

two accelerator position sensors for detecting a position of an accelerator;

a target position setting means for setting a target position of a throttle valve disposed in an intake system depending upon engine operation conditions inclusive of the position of the accelerator detected by one accelerator position sensor selected from said two accelerator position sensors;

two throttle position sensors for detecting a position of said throttle valve;

a throttle valve drive means for opening and closing said throttle valve using an actuator, so that the position of said throttle valve detected by one throttle position sensor selected from said two throttle position sensors reaches the target position;

a first fail-safe means which, when either one of said two accelerator position sensors or either one of said two throttle position sensors fails to operate, controls the position of said throttle valve using a value detected by the remaining sensor; and a second fail-safe means which, in a state where one sensor fails to operate between said two accelerator position sensors or one sensor fails to operate between said two throttle position sensors, interrupts the operation of said first fail-safe means to hold said throttle valve at a predetermined position when an operation for decelerating the engine is detected by a sensor in a system separate from said sensors.

14. An apparatus for fail-safe controlling an electronically-controlled throttle valve of an internal combustion engine according to claim 13, wherein the sensor of said separate system includes an idle switch for detecting the idling state of the engine.

15. An apparatus for fail-safe controlling an electronically-controlled throttle valve of an internal combustion engine according to claim 13, wherein the sensor of said separate system includes a brake switch for detecting the operation of the brake.

16. An apparatus for fail-safe controlling an electronically-controlled throttle valve of an internal combustion engine according to claim 13, wherein said second fail-safe means interrupts the drive of said actuator, to hold the throttle valve at a predetermined position relying upon a balance of urging forces of two springs.

17. An apparatus for fail-safe controlling an electronically-controlled throttle valve of an internal combustion engine according to claim 13, wherein said second fail-safe means sets the target position of the throttle valve to the predetermined position to hold the throttle valve at the predetermined position by driving the actuator.

18. An apparatus for fail-safe controlling an electronically-controlled throttle valve of an internal combustion engine according to claim 13, wherein either one of the two accelerator position sensors or either one of the throttle position sensors is determined to be in failure when the failure state of the sensor continues for a predetermined period of time.

19. An apparatus for fail-safe controlling an electronically-controlled throttle valve of an internal combustion engine comprising:

two accelerator position sensors for detecting a position of an accelerator;

a target position setting means for setting a target position of a throttle valve disposed in an intake system depending upon engine operation conditions inclusive of the position of the accelerator detected by one accelerator position sensor selected from said two accelerator position sensors;

two throttle position sensors for detecting a position of said throttle valve;

a throttle valve drive means for opening and closing said throttle valve using an actuator, so that the position of said throttle valve detected by one throttle position sensor selected from said two throttle position sensors reaches the target position;

a single-failure fail-safe means which, when either one of said two accelerator position sensors or either one of said two throttle position sensors fails to operate, controls the position of said throttle valve using a value detected by the remaining sensor; and a single-failure fail-safe permission means which permits the operation of said single-failure fail-safe means when a low-speed fail-safe operation of a minimum compensation, that is, an operation for maintaining a minimum output required for limp-home control operation of the engine, is executed after said one of the two accelerator position sensors or said one of the two throttle position sensors has been determined to be in failure.

20. An apparatus for fail-safe controlling an electronically-controlled throttle valve of an internal combustion engine according to claim 19, wherein said low-speed fail-safe operation of the minimum compensation is the one in a state where the throttle valve, after the accelerator pedal is released, is near a predetermined position for compensating the fail-safe operation.

21. An apparatus for fail-safe controlling an electronically-controlled throttle valve of an internal combustion engine according to claim 19, wherein the low-speed fail-safe operation of the minimum compensation is the one in a state where the throttle valve, after the brake is operated, is near a predetermined position for compensating the fail-safe operation.

22. An apparatus for fail-safe controlling an electronically-controlled throttle valve of an internal combustion engine according to claim 19, wherein when said actuator is no longer operated, the throttle valve is held at a predetermined position for compensating the low-speed fail-safe operation of the minimum compensation relying upon a balance of urging forces of two springs.

23. An apparatus for fail-safe controlling an electronically-controlled throttle valve of an internal combustion engine according to claim 19, wherein the one sensor of the two accelerator position sensors or the one sensor the two throttle position sensors is determined to be in failure when the failure state of said one sensor continues for a predetermined period of time.

24. An apparatus for fail-safe controlling an electronically-controlled throttle valve of an internal combustion engine comprising:

two accelerator position sensors for detecting a position of an accelerator;

a target position setting means for setting a target position of a throttle valve disposed in an intake system depending upon engine operation conditions inclusive of the position of the accelerator detected by one accelerator position sensor selected from said two accelerator position sensors;

two throttle position sensors for detecting a position of said throttle valve;

a throttle valve drive means for opening and closing said throttle valve using an actuator, so that the position of said throttle valve detected by one throttle position sensor selected from said two throttle position sensors reaches the target position;

a first fail-safe means which, when either one of said two accelerator position sensors or either one of said two throttle position sensors fails to operate, controls the position of said throttle valve using a value detected by the remaining sensor;

a first fail-safe permission means for permitting the operation of said first fail-safe means after executing the low-speed fail-safe operation of the minimum compensation after the determination of one of said two accelerator position sensors or one of said throttle position sensors to be in failure; and a second fail-safe means which, in a state where one sensor fails to operate between said two accelerator position sensors or one sensor fails to operate between said two throttle position sensors, interrupts the operation of said first fail-safe means and, instead, holds said throttle valve at a predetermined position when an operation for decelerating the engine is detected by a sensor in a system separate from said sensors.

* * * * *